United States Patent [19]

Viessmann

[11] Patent Number: 4,955,432

[45] Date of Patent: Sep. 11, 1990

[54] HOT GAS FLUE PIPE

[76] Inventor: Hans Viessmann, Im Hain, D-3559 Battenberg/Eder, Fed. Rep. of Germany

[21] Appl. No.: 331,631

[22] Filed: Apr. 25, 1989

[51] Int. Cl.[5] ..... F28F 21/08

[52] U.S. Cl. ..... 165/81; 165/179; 165/180; 138/147

[58] Field of Search ..... 165/81, 180, 179; 138/147

[56] References Cited

U.S. PATENT DOCUMENTS 2,240,474 4/1941 Welch ..... 165/180
3,231,014 1/1966 Koenig ..... 165/180

FOREIGN PATENT DOCUMENTS 1778832 8/1971 Fed. Rep. of Germany .
27692 6/1987 Fed. Rep. of Germany .
825947 12/1959 United Kingdom ..... 165/180

*Primary Examiner*—Albert W. Davis, Jr.
*Attorney, Agent, or Firm*—Kurt Kelman

[57] ABSTRACT

There is disclosed a hot gas flue pipe assembly designed for use inside a heating boiler. The assembly has an outer pipe and an inner pipe, and the outer pipe envelopes the inner pipe in such a way that circumferential contact deformations disposed at least in separate sub zones are capable of transferring heat between the two pipes. In order to prevent the occurrence of cracking noises during the flow of hot flue gases through the hot gas flue pipe, or at least to reduce such noises to an acceptable level, the inner pipe comprises one or more sections which, when inserted inside the outer pipe, define with their opposed ends, a circumferential gap that is filled with an elastic, heat-resistant and moisture-resistant cementitious material.

8 Claims, 1 Drawing Sheet

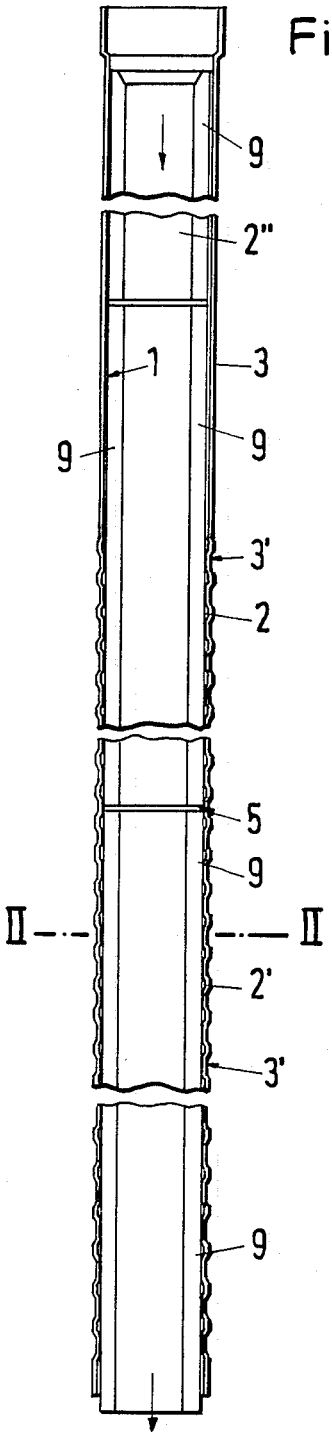
Fig.1
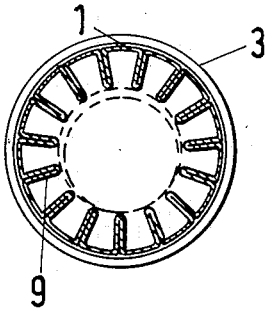
Fig.2
Fig.3
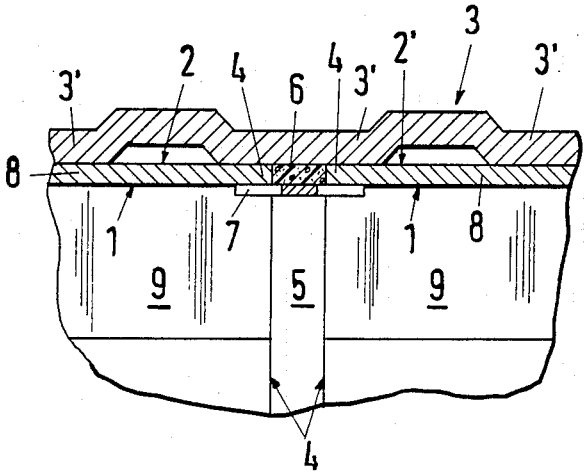
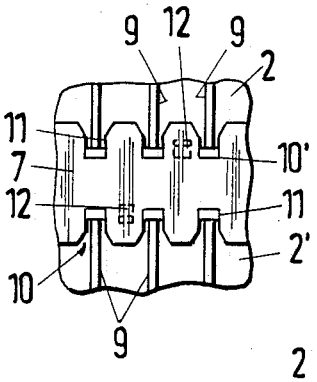
Fig.4
Fig.5
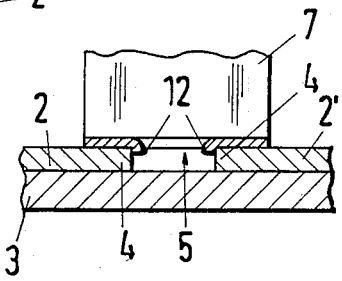

HOT GAS FLUE PIPE

BACKGROUND OF THE PRESENT INVENTION

The present invention relates a hot gas flue pipe.

More particularly, this invention relates to a hot gas flue pipe assembly suitable for installation inside a boiler, the pipe assembly having an inner pipe and an outer pipe and wherein the latter is in heat-conducting contact or relationship, along a portion of its integral length, with the inner pipe so that the heat conducting contact is attained by means of circumferential contact deformations disposed at least in sub-zones of the outer pipe.

DESCRIPTION OF RELATED ART

One type of a hot gas flue pipe is known from DE-AM 83 27 692. These hot gas flue pipes, which are conventionally installed in groups inside a water-filled inner cavity of a boiler casing, are known for their high performance characteristics. It has since been discovered, however, that such pipes expand longitudinally and also have a tendency to produce loud cracking sounds, since the outer pipe is cooled by a heat carrier medium, while the inner pipe is subjected to direct loading by flowing hot gases. Such loud cracking noises are increased by a virtually rigid mechanical connection which normally exists between both pipes, the inner pipe being clamped or held in position inside the outer pipe.

SUMMARY OF THE PRESENT INVENTION

A principal object of the present invention is to provide a hot gas flue pipe of the above-mentioned type, which is capable of either eliminating or substantially reducing cracking sounds.

A further object of the present invention is to protect by suitable means, the cement or cementitious material at the joint between the pipes from direct thermal loading by hot gases.

Another object of the present invention is to enlarge the heat transfer surface of the inner pipe to accommodate the protective covering for the cement material.

Still another object of the present invention is to use the covering annulus(i) to separate the inner pipe sections to be inserted and thus to define the width of the gaps separating such sections.

A further object is to stabilize the inner pipe sections, which have folds forming longitudinal ribs, and thus also to stabilize the cement material located in the gap zone.

Further objects of the present invention will become apparent from the following description and claims.

The principal object of one embodiment of the present invention is attained by an inner pipe constructed of one or more sections which, after being placed inside an outer pipe, define with their opposing ends a circumferential gap therebetween which is filled with an elastic, heat-resistant and moisture-impermeable cementitious material.

By means of the present invention and according to a preferred embodiment, wherein the cement arranged in the gap replaces the moisture-resistant wall of the inner pipe, the general expansion of the otherwise continuous inner pipe can be effectively distributed over all the sections of the inner pipe and thus serve to counter-act noise development. It is important that the gap introduced between the ends of the two pipe sections not remain unsealed, and thus compromise moisture resistance; rather, this gap must be filled with a material having elasticity, heat resistance and moisture-resistance characteristics. The gap, once filled with cementitious material, can then be covered by an annulus or sleeve of thin sheet metal.

The system of the present invention is particularly suitable for use in conjunction with inner pipes fitted with helical or linearly-extending ribs; as is known, such ribs as disclosed in DB-PS 17 38 832 can be formed by suitably folding or crimping the wall of the inner pipe. Such internal ribbing serves to augment the heat absorption capacity of the inner pipe, and therefore the expansion of the inner pipe, which is virtually locked in position inside the outer pipe. The annulus proposed for covering the cement-filled gap advantageously has grooves at both ends, into which the ends of the ribs of both adjacent inner pipe sections fit with a desired or predetermined amount of longitudinal movement.

The annulus serves not only to cover the cement filling the gaps between pipes, but also serves to ensure that the orientation of the ribs or more specifically, the ends of the ribs of both ribbed-pipe sections, are aligned with each other. Such an arrangement greatly facilitates cleaning of the hot gas flue pipe assembly.

Care must be exercised, during assembly of the hot gas flue pipes, that the width of the gap remains constant during insertion of the inner pipe section, since the elastic cement, which is used to fill the gap, must be moved in together with the pipe sections. This arrangement also facilitates insertion, since the outer diameter of the inner pipe is intended to be smaller than the inner diameter of the outer pipe, so that the difference in diameter is compensated for by the presence of contact deformations in the outer pipe. It is still, nevertheless, largely possible to maintain a constant gap width between the opposing ends of the inner pipe sections; the covering annulus or sleeve designed for the gap separating the pipe ends can be used during insertion in conjunction, both with a smooth and an inner-ribbed inner pipe, in order to maintain the required inter-pipe gap width. This may be easily accomplished by providing the annulus on both of its circumferential edges with one or more small, outwardly-bent stop tabs that serve, wherever both inner pipe sections have been assembled together, to separate both pipe ends. Start-up of a boiler system provided with the hot gas flue pipes of this invention will initially cause expansion of both inner pipe sections, which in turn causes the small tabs to bend backwards. The tabs then remain in their bent-back position. Small tabs of this type can also be arranged on the annuli designed to maintain a constant distance between the inner-ribbed inner pipes.

It is also possible, in the latter example, to both use the covering annuli serving to maintain the flush position of both ribbed ends of the two inner pipes, and as well, to employ an additional or auxiliary separating annulus of combustible material which functions, during insertion, to separate the two pipes at their maximum distance. Since these auxiliary separating annuli are directly exposed to the flow of hot gases, they will be consumed when the boiler is started up.

Another preferred alternate embodiment of the hot gas flue pipe assembly of this invention comprises an assembly wherein at least a portion of the longitudinal extension of the outer pipe-facing cleft of the ribs, which are folded out of the wall of the inner pipe, are welded together by means of longitudinal weld seams. This arrangement provides for improved form stability in the inner pipe and thus uniform expansion characteristics, which, in the present example, greatly reduces noise buildup. It is advantageous, in this connection the longitudinal welded seams are embodied and arranged as so-called "drop welded seams" i.e. the folded inner pipe wall is provided with such longitudinal welded seams after being stood upright; this technique permits the formation of weld seams at higher speeds Clearly such double-walled hot gas flue pipes of this invention are effective in reducing noise.

BRIEF DESCRIPTION OF THE DRAWINGS

Having thus generally described the invention, reference will now be made to the accompanying drawings, illustrating preferred embodiments, and in which:

FIG. 1 illustrates a longitudinal section through a hot gas flue pipe of this invention;

FIG. 2 illustrates a cross sectional view, through a preferred embodiment of the hot gas flue pipe, taken along the line II—II of FIG. 1;

FIG. 3 illustrates an enlarged partial section of the hot gas flue pipe;

FIG. 4 illustrates a plan view of the gap zone together with inserted cover and alignment annulus;

FIG. 5 illustrates an enlarged partial section of a preferred embodiment of the covering annulus.

DESCRIPTION OF PREFERRED EMBODIMENTS

A hot gas flue pipe assembly of the present invention comprises an outer pipe 3 together with an inner pipe 1, with the outer pipe 3 fitting around and pressing against the inner pipe 1 by means of contact deformations 3' which also function to transfer heat. The flow direction of the hot gases, shown in Fig. 1, is indicated by arrows; it will also be seen that the contact deformations 3' are provided over the greater portion of the integral length of the hot gas flue pipe 3, i.e. in areas where moisture build up is normally the greatest. The inlet zone of the hot gas flue pipe 3 is not provided with the contact deformations 3'. The inner pipe 1 of the embodiment illustrated of the hot gas flue pipe assembly comprises three sections, i.e. sections 2, 2', 2''. As the enlarged view of FIG. 3 illustrates, the ends 4 of sections 2 and 2', disposed inside the outer pipe 3, have a circumferentially extending gap 5 that is filled by an elastic, heat-resistant and moisture-resistant cement 6. Gap 5 and the cement 6 which is arranged therein, are covered by an annulus or sleeve 7.

The embodiment illustrated in FIG. 3 shows, in greater detail, the arrangement of FIGS. 1 and 2, i.e. the embodiment of the present invention wherein the wall 8 of the inner pipe 1 is folded or formed into ribs 9 which are oriented towards the inside of the inner pipe. Quite independently of this arrangement, such an embodiment including the gap, cement and annulus, can also be used in conjunction with a non-ribbed inner pipe, e.g. inner pipe portion 2'' of FIG. 1 could be structured, on the inlet side, as a smooth pipe.

In the embodiment disclosed in FIGS. 1 to 4, where the inner pipe 1 or inner pipe sections 2, 2' and 2'' have ribs 9, the annulus 7 is constructed in the manner outlined in FIG. 4, which also illustrates that the annulus 7 is provided on both of its ends with grooves 10, into which the ends 11 of ribs 9 of both inner pipe portions 2, 2' fit with a desired tolerance or allowance. An annulus thus constructed fulfills two roles, namely, that of covering the cementitious mass introduced into the gap 5 when inner pipe 2 is inserted into outer pipe 3, and that of keeping, by means of the grooves 10, the ribs 9 of pipe sections 2, 2' in flush alignment with each other. FIG. 4 furthermore illustrates that there exists, during a system shut down, a space between the ends 11 of ribs 9 and a groove floor 10', which, when pipe sections 2, 2' are heated and stretched, permits a corresponding expansion in the pipe sections.

If, during insertion of inner pipe 1 or, more specifically, sections 2, 2', no special precautions have been taken so as to maintain a minimum distance between both pipes, (as mentioned above) the annulus may, for this purpose, be advantageously provided on both of its end edge zones with one or more spacing tabs 12. Such an arrangement is particularly suitable for bridging gaps and for separating inner pipes possessing no inner ribbing, since the ends 11 of ribs 9 are otherwise incapable of maintaining a distance between the two pipes. Since, as FIG. 5 indicates, annulus 7 comprises e.g. a relatively thin sheet of metal, spacing tabs 12, which are bent towards outer pipe 3, are capable of maintaining the required inter-pipe spacing during insertion of the inner pipe 1 inside the outer pipe 3. Such small spacing tabs 12 can furthermore be bent upwardly very simply during expansion of the inner pipe sections 2' in relation to the end edges of sections 2, 2', whereafter they then remain in that position. FIG. 4 clearly suggests that this spacing principal can be applied to annuli used in conjunction with this special embodiment.

During assembly of the hot gas flue pipe, combination, an inner pipe section is first inserted as far as possible into the outer pipe 3, and an annulus 7 is immediately placed onto such section; assuming that sufficient cementitious material 6 has been applied around the entire inter-pipe gap, the subsequent inner pipe section is moved into place and the complete assembly is then moved further into outer pipe 3. After inner pipe 2 has been fully inserted together with its sections 2, 2', 2'' into outer pipe 3, contact deformations 3' are, with the aid of suitable equipment, made in outer pipe 3 in order to press the outer pipe 3 firmly against inner pipe 1.

Ribs which are formed by and project outwardly of the pipe wall, are welded with longitudinal weld seams along the clefts of ribs 9 , such seams being, in order to facilitate economical production, embodied and arranged as so-called "drop-weld" seams. In this method, a metal sheet, pre-folded and rolled into a cylindrical inner pipe 1, mounted on its end and provided with drop weld seams by vertically downward travel of a plurality of welding torches. This method provides for improved welding speeds for production of the inner pipe 1. Depending on the number of circularly-positioned welding torches, the welding apparatus need only be rotatably shifted two or three times about the longitudinal axis of the cylindrical inner pipe in order to cover all of the fold clefts with longitudinal weld seams.

With respect to the thermal expansion of the system, and in order to achieve stabilization of the entire pipe, particularly in the highly thermally-loaded flow zone 15, the outer pipe 3 is provided in this zone with one or more clamping rings 14, (preferably when warm), that can be e.g. simply slipped over the cold pipe, so that the rings will later contract against the outer pipe 3 when it is cold.

While I have illustrated and described only some embodiments of my invention, it will be evident that there are numerous possible modifications and alternatives within the purview of my broad inventive concept. Hence, I do not wish to be limited either as to the particular details of construction or as to the size of the unit the only intended limitations being those clearly indicated by the express terms of the appended claims:

I claim:

1. A hot gas flue pipe assembly suitable for installation inside a heating boiler, said hot gas flue pipe assembly comprising an outer pipe and an inner pipe, said outer pipe having heat transfer contact points said outer pipe being in contact with said inner pipe over at least a portion of its length and further in contact in at least in sub-zones thereof by means of circumferential contact deformations so as to facilitate heat transfer, said inner pipe comprising at least one section, said inner pipe delimiting with the opposing ends of its sections a circumferential gap that is filled with an elastic, heat-resistant and moisture-resistant cement.

2. The hot gas flue pipe assembly in accordance with claim 1, wherein said gap having said cement therein is protected within said inner cavity of said pipe by means of an annulus.

3. The hot gas flue pipe of claim 2, wherein the wall of said inner pipe is provided with ribs which, folded preferably out of said wall and oriented toward the inside of said pipe, are either twisted or extend linearly in the direction of flow and whereby furthermore said annulus is provided on both of its ends with grooves, into which the ends of the said ribs of both said inner pipe sections fit with a measure of longitudinal play.

4. The hot gas flue pipe assembly of with claim 2, wherein more spacing tabs are arranged in each end edge zone of said annulus.

5. The hot gas flue pipe assembly of claim 3, wherein said longitudinal ribs, project outwardly of said wall of said inner pipe, said ribs being welded together by longitudinal weld seams in clefts thread facing said outer pipe along at least a portion of their longitudinal extension.

6. The hot gas flue pipe assembly of claim 5, wherein said longitudinally welded seams are drop-welded seams.

7. The hot gas flue pipe assembly of claim 1, wherein said outer pipe is provided, at its inlet zone, with one or more clamping sleeves or rings.

8. The hot gas flue pipe assembly of claim 3, wherein said annulus is provided at each of its end edge zones with two or more spacing tabs.

* * * * *